US005328657A

United States Patent [19]

Kamel et al.

[11] Patent Number: 5,328,657

[45] Date of Patent: Jul. 12, 1994

[54] METHOD OF MOLDING METAL PARTICLES

[75] Inventors: Ihab L. Kamel, Drexel Hill; Alan Lawley, Wynnewood, both of Pa.; Myung-Ho Kim, Kyung-Nam, Rep. of Korea

[73] Assignee: Drexel University, Philadelphia, Pa.

[21] Appl. No.: 841,682

[22] Filed: Feb. 26, 1992

[51] Int. Cl.[5] ..... B22F 3/12

[52] U.S. Cl. ..... 419/36; 419/54; 419/38

[58] Field of Search ..... 419/36, 38, 54

[56] References Cited

U.S. PATENT DOCUMENTS

| | | | |
|---|---|---|---|
| 3,539,472 | 11/1970 | Findeisen et al. | 252/51.5 |
| 4,113,480 | 9/1978 | Rivers | 75/214 |
| 4,483,905 | 11/1984 | Engström | 428/570 |
| 4,504,441 | 3/1985 | Kuyper | 419/35 |
| 4,588,441 | 5/1986 | Ikenoue et al. | 75/230 |
| 4,906,424 | 3/1990 | Hughes et al. | 264/63 |
| 4,931,252 | 6/1990 | Brunisholz et al. | 419/23 |
| 4,954,169 | 9/1990 | Behrens | 75/228 |
| 4,976,778 | 12/1990 | Berry et al. | 75/254 |
| 5,006,164 | 4/1991 | Kiyota | 75/255 |

*Primary Examiner*—Donald P. Walsh
*Assistant Examiner*—Daniel Jenkins
*Attorney, Agent, or Firm*—Panitch Schwarze Jacobs & Nadel

[57] ABSTRACT

The present method relates to molding metal particles by forming a flowable mixture. The metal particles are mixed with a polyorganic acid which chemically reacts with the metal particles. The flowable mixture is transferred to a mold before the chemical reaction between the metal particles and the polyorganic acid proceeds so far as to substantially increase the viscosity of the flowable mixture. A green preform is created by applying pressure to the mixture in a mold. The green preform is heated to a first temperature to vaporize substantially all of the non-organic components of the reacted polyorganic acid from the preform. The preform is then heated to a second temperature greater than the first temperature to sinter the metal particles.

22 Claims, 3 Drawing Sheets

METHOD OF MOLDING METAL PARTICLES

FIELD OF THE INVENTION

The invention relates to a method for molding metal particles and, more particularly, to forming a flowable mixture to facilitate molding of the metal particles.

BACKGROUND OF THE INVENTION

The formation of intricately or irregularly shaped parts, such as mold cavities for the injection molding of thermoplastics, gears, sprockets, or threaded parts, may involve many processing steps. Often the formation process involves the steps of casting, machining, heat treatment for hardening, tempering, polishing and plating of the parts. Significant volume changes during casting may require expensive and careful processing. Machining and polishing can be particularly difficult for intricate or irregular shapes. The formation of parts from very hard, corrosion resistant alloys greatly increases the difficulty in processing.

Multiple cavities are often formed in a part by hobbing or cold forming of the metal surface of the part. Pressure from a harder metallic replica of a desired part (hob) may be applied to form the mold cavity. However, this process requires the use of a softer metal, such as low carbon steel, and case hardening and polishing of the cast part.

The molding of parts from metal powder may also be accomplished by "press and sinter metallurgy", which comprises the steps of filling a mold with a powder, compacting the powder, and heating the powder to cause the particles to bond together by sintering. This process is impractical for the formation of complex parts because it is difficult to achieve a uniform density of the powder in irregular mold shapes.

In the "powder-injection molding" process, a binder/powder paste mixture is formulated in which the binder serves as a lubricant. The mixture is then forced into the mold under pressure and the binder subsequently removed by heating. Finally, the resulting part is heated to its sintering temperature. While this process is an improvement over the first generation "press and sinter metallurgy" process, the resulting parts shrink considerably when heated to remove the binder from the preform, and there are limitations on the size of parts that can be fabricated by this process. Examples of this type of powder-injection molding include the following:

U.S. Pat. No. 4,113,480 discloses a method for injection molding parts formed from powdered metals by mixing the powder with a plastic medium comprising an organic binder and modifiers dissolved in a solvent. The solvent may be volatilized upon heating and the organic binder may be volatilized or sublimed during sintering. The disclosed preferred organic binder is methyl cellulose and the preferred solvent is water. Modifiers, which may be used to promote mold release and prevent the formation of cracks, include a combination of glycerin and boric acid.

U.S. Pat. No. 4,483,905 discloses a composition comprising a metal powder and a binding agent in solid or liquid state. The preferred binding agents are polyethylene glycols, polypropylene glycols, polyvinyl alcohol and glycerol.

U.S. Pat. No. 4,504,441 discloses a method for preventing segregation of powders having different specific gravities in a metal powder composition. The powdered metal and lubricant powder are mixed with furfuryl alcohol and an acid such as toluene sulfonic acid to convert the alcohol to a solid resin film on the powder metal particles. The polymerization of the alcohol may take place during mixing.

U.S. Pat. No. 3,539,472 discloses a process for producing molded metal powder articles by the use of mold-facilitating lubricants consisting of amides or diamides of aliphatic monocarboxylic acids and alcohols or diols or polyglycols. The lubricant mixtures may be burned out of the metal powder article formed by the process.

U.S. Pat. No. 4,906,424 discloses a method for injection molding ceramic or metallic powders by use of a binder. The ceramic powder may have a multimodal particle size distribution such that smaller diameter particles are provided to fill the interstices between larger particles. The primary binder material is a polymerized monomer or mixture of monomers which may be polymerized thermally, radiatively, or catalytically. The polymerized monomers may include various polyols. Suitable dispersants or surfactants such as oleic acid and stearic acid may be included in the binder as processing aids.

The mixture of binder and ceramic or metallic material may be injection molded. The mold temperature is maintained at about 50° C. to about 200° C. to initiate polymerization. The binder may be burned off by heating the preform to a temperature below about 700° C. Finally, the molded article is sintered at a temperature ranging from approximately 700° C. to 2200° C. to obtain the final product.

The aforementioned prior art processes have two significant drawbacks. First, it is often difficult to form intricate or irregularly shaped parts because the powder compositions have inadequate flow properties which lead to density variations within the parts. In addition, the aforementioned processes often produce shrinkage and distortion of parts during heating phases, since binders are essentially totally removed without modifying the connecting structure between the powder particles.

SUMMARY OF THE INVENTION

According to the present invention, the above and other deficiencies of the prior art are alleviated or eliminated by a method for molding metal particles in which the metal particles are mixed with a polyorganic acid to form a generally flowable mixture. The polyorganic acid is one which will chemically react with the metal particles. The flowable mixture is transferred to a mold before the chemical reaction between the metal particles and the polyorganic acid proceeds so far as to substantially increase the viscosity of the flowable mixture. Pressure is then applied to the flowable mixture in the mold to form a preform. The preform is heated to a first temperature to vaporize substantially all of the non-organic or non-carbon components of the reacted polyorganic acid from the preform. Finally, the preform is heated to a second temperature greater than the first temperature to sinter the metal particles.

BRIEF DESCRIPTION OF THE DRAWINGS

The foregoing summary, as well as the following detailed description of the preferred embodiments, will be better understood when read in conjunction with the appended drawings. For the purpose of illustrating the invention, there are shown in the drawings embodiments which are presently preferred, it being understood, however, that the invention is not limited to the specific arrangements and instrumentalities disclosed. In the drawings.

DETAILED DESCRIPTION OF THE PREFERRED EMBODIMENTS

Figure 1:
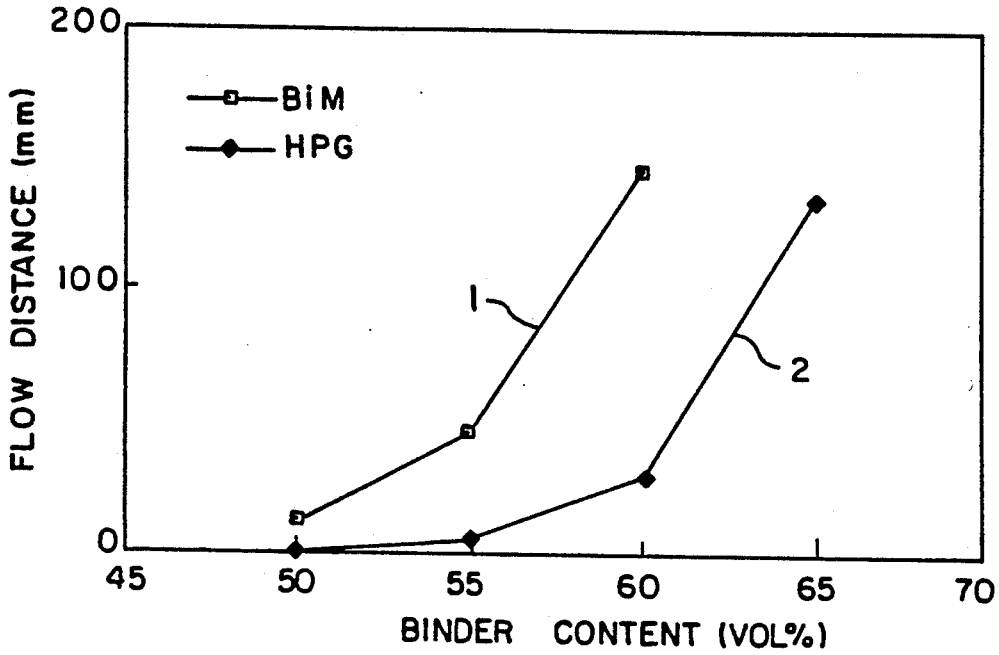
FIG. 1 is a graph of the flow distance measured in millimeters as a function of binder content measured in volume percent for several embodiments of the present invention.

The metal particles useful in the methods of the present invention may be selected from transition metals and alloys thereof. For example, the metal particles may be iron, cobalt, nickel or alloys thereof. Preferably, the metal particles are iron or an iron alloy, such as carbon steel. One of ordinary skill in the art, however, would understand that any type of metal particle may be useful in the present invention.

Preferred metal particles are in the form of a prealloyed low-alloy steel powder, such as the product ANCORSTEEL 85HP TM powder which is commercially available from Hoeganaes Corporation of Riverton, N.J. The ANCORSTEEL 85HP TM powder is composed of less than about 0.01% by weight carbon, about 0.14% by weight manganese, about 0.84% by weight molybdenum, about 0.07% by weight oxygen and the remainder iron.

It is preferred that the metal particles comprise first and second groups of particles, the first group having an average particle size or average particle diameter greater than the average particle size of the second group, i.e., a bimodal particle size distribution. Alternatively, a plurality of groups of differently sized metal particles may be used to form a multimodal mixture of selected particle sizes or the metal particles may be of a uniform average particle size. The smaller sized particles are used to fill void space between the larger sized particles. The smaller sized particles may be of the same or a different metal than the larger sized particles. Preferably, the smaller sized particles are carbonyl iron fine powder.

The particle size affects the minimum binder level necessary for gravity-induced flow and the rate and temperature of the sintering process. Smaller sized powder particles having a large total surface area are preferred for ease of sintering. A preferred first group of metal particles is about 106 to about 150 μm ANCORSTEEL 85HP TM powder. A preferred second group of metal particles is about 5 μm carbonyl iron fine powder.

The preferred proportion of first and second groups of metal particles is influenced in part by the particle size distribution of the first group of metal particles. Generally the proportion of metal particles of the first group may be about 70 to 90 wt % to about 10 to about 30 wt % of metal particles of the second group. A preferred proportion of the first and second groups of metal particles having the above preferred particle sizes is about 80 wt. % ANCORSTEEL 85HP TM powder to about 20 wt. % carbonyl iron fine powder. However, one of ordinary skill in the art would understand that the first and second groups of metal particles may be in any proportion in keeping with the spirit and scope of the present invention.

The method comprises mixing the metal particles with a binder which comprises a polyorganic acid which will chemically react with the metal particles. The metal particles and polyorganic acid first form a generally flowable mixture or slurry. The chemical reaction between the metal particles and the polyorganic acid generally commences upon mixing of the two components. It is believed that the pendant acid groups of the polyorganic acid react with metal ions on the surface of the metal particles to form covalently bonded structures. The slightly exothermic reaction is generally accompanied by a hydrogen release.

For example, a reaction in accordance with the present invention between a carboxylic acid and iron may be expressed by the following equation:

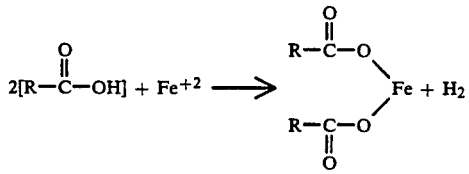

(1)

in which R may be a substituted or unsubstituted polyorganic group. The polyorganic group may comprise a long chain polymer which may contain such organic groups as aliphatic, aromatic, or a mixture of both. One of ordinary skill in the art would understand that the polyorganic acid and metal of the preceding example are presented merely for purposes of illustration and that any polyorganic acid or metal may be used in accordance with the present invention.

The polyorganic acid may, for example, be a long-chain compound with one or more multifunctional acid groups or copolymers which include chain segments of polyacids. The preferred polyorganic acid is polyacrylic acid, such as the product ACUMER TM which is commercially available from Rohm and Haas Co. of Philadelphia, Pa.

It is further preferred that the polyorganic acid be in the form of an aqueous solution. In the aqueous solution, positively charged hydrogen is dissociated from the polyorganic acid group. The preferred product ACUMER TM is composed of about 25% by volume polyacrylic acid and about 75% by volume water. However, one of ordinary skill in the art would understand that any amount of water or other solvent for the acid which provides the desired flowability in accordance with the present invention may be used. Other solvents which do not participate in or hinder the reaction between the polyorganic acid and metal particles may also be used to provide the desired flowability.

Preferably, the metal particles and polyorganic acid are mixed at room temperature (about 25° C.). The rate of reaction between the metal particles and polyorganic acid may be increased at higher temperatures or decreased at lower temperatures.

The proportion of metal powder to the solution of polyorganic acid depends in part upon the powder particle size and size distribution between the first and second groups of metal particles. The amount of binder should be sufficient to wet substantially all of the surface area of the metal particles. Generally, the proportion of metal powder to the solution of polyorganic acid (binder) solution should be about 40 to about 60 volume percent binder, although one of ordinary skill in the art would understand that the proportion of binder may be less than 40% or greater than 60% by volume. For example, if the metal powder particles are about 5–7 μm in size (unimodal), about 70 volume percent binder may be necessary to obtain the desired slurry characteristics. Generally, the binder level should be greater than 25% to obtain the desired slurry characteristics and is preferably about 55–60% by volume.

The step of mixing the metal particles with the polyorganic acid may also include mixing the metal particles and polyorganic acid with a second organic compound. The polyorganic acid and second organic compound are preferably mixed and stirred to form a homogeneous fluid binder before mixing the organic components with the metal particles. The second organic compound preferably does not react with the metal particles but instead reacts with the polyorganic acid. The second organic compound may function as a flow aid and enhance the green strength of the compacted mixture prior to sintering.

Such organic compounds may preferably include a polyol, such as glycerol. Glycerol is preferred because its range of viscosity is acceptable for enhancing the flow of the slurry. A preferred proportion of the aqueous solution of polyorganic acid to the second organic compound is approximately 3 to 1, although one of ordinary skill in the art would understand that the ratio of the aqueous solution of polyorganic acid to the second organic compound may be any ratio which enhances the flow of the slurry and the green strength of the preform before sintering.

In an alternative embodiment, the metal particles may be mixed with small amounts (e.g., about 0.5 percent by weight) of graphite to enhance removal of the article from the mold and to increase the strength of the final sintered article.

Referring now to FIG. 1, a conventional funnel type flow meter was used to measure the flow distance in mm of metal powder slurries at room temperature and atmospheric pressure. The binder for each slurry was composed of 3 parts ACUMER TM to 1 part glycerin. Slurries of about 80 weight percent ANCORSTEEL 85HP TM powder (106–150 μm) and about 20 weight percent carbonyl iron fine powder (5 μm), generally designated "BiM", were evaluated using 50, 55, and 60 percent by volume of binder. Slurries of about 99.5 weight percent ANCORSTEEL 85HP TM and about 0.5 weight percent graphite, generally designated "HPG", were evaluated using 50, 55, 60, and 65 percent by volume of binder. Graphite is typically added to monomodal metal powders to facilitate mold release and strengthen the sintered product.

The bimodal metal particle mixture (BiM) consists of two distinctly different particle size groups, whereas the monomodal mixture (HPG) is, for the most part, composed of a single particle size group. As best shown in FIG. 1, the bimodal metal particle mixture (BiM), indicated generally by line 1, exhibits a greater flow distance with less binder content than the monomodal mixture (HPG), indicated generally by line 2. Therefore, a multimodal metal particle mixture having at least two different particle size groups is preferred for increasing the flowability of the metal particle/binder mixture and density of the molded article.

The generally flowable mixture is then transferred to a mold before the chemical reaction between the metal particles and the polyorganic acid proceeds so far as to substantially increase the viscosity of the flowable slurry. A substantial increase in the viscosity, as used herein, is defined to mean an increase in viscosity sufficient to prevent the flowable mixture from flowing into and filling the crevices (small dimensional areas) of the mold, whether by gravity-induced flow or pressurized flow, as desired, before the mixture sets.

The viscosity and flow rate of the slurry are a function of the binder level, binder viscosity, particle size, particle size distribution of the metal particles and the temperature at which the reaction is conducted, among other variables. The viscosity of the mixture may be varied by adjusting one or more of these variables in accordance with desired processing conditions. The gravity-induced flow rate of the mixture may also vary depending on the size and configuration of the mold cavity and the pressure applied to the mixture to further induce flow. The transfer is preferably accomplished in about 5 minutes to about several hours, although this time period may be shortened somewhat or lengthened by adjusting the variables discussed above. Generally, increased binder levels and lower binder viscosity enhance flowability of the slurry. Smaller particle sizes and increased temperature also decrease the viscosity of the slurry and enhance flow.

The mold to which the slurry is transferred may be constructed of a rigid or flexible material, such as rubber or plastic. Preferably, the mold includes a porous member such as a ceramic core or a porous metal insert which allows the escape of excess binder during compaction. The porous metal insert may be formed from bronze or stainless steel and may have a porosity of approximately 50% by volume. Alternatively, a bleeder line or vent tubes may be used in place of a porous insert to reduce the binder in the preform before sintering.

After the flowable slurry is transferred to the mold, pressure is applied to the flowable slurry to form a preform in the green state. By applying pressure, a portion of the unreacted binder and/or solvent and other organics, if any, are squeezed from the flowable mixture to form the preform. The metal particles are generally not deformed by the applied pressure. It is preferred that the pressure be applied hydrostatically (such as in a flexible mold) rather than uniaxially to eliminate any constraints on the complexity of the molded article. For simplicity, the articles fabricated as examples below were produced by application of uniaxial pressure.

A preferred pressure is about 1.6 to about 2.5 tons per square inch applied for a period of about one hour at room temperature, although one of ordinary skill in the art would understand that the pressure level and duration may vary based upon such factors as the types and quantities of material and processing equipment employed. The pressure may be applied by any conventional pressurizing device or method, such as die compaction (DC). For example, the slurry may be die compacted by use of a conventional metallographic mounting press. An example of such a press is the "Pneumatic Press" (Catalog No. 10-1360-115), which is commercially available from Buehler, Ltd. of Evanston, Ill.

The method further comprises the step of heating the green preform to a first temperature of about 400° C. to about 600° C. to vaporize substantially all of the non-organic or non-carbon components of the reacted polyorganic acid and reacted second organic compound, if any, from the green preform. That is, the carbon chains of the reacted organic compounds appear to remain as a stable skeleton which remains between the metal particles so that the particles are still bonded together even after the polyorganic acid and any reacted second organic compound have been degraded by the heat. The non-organic or non-carbon components may be, for example, hydrogen and oxygen. In addition, this step may comprise vaporizing substantially all of the unreacted polyorganic acid from the green preform.

Preferably, the green preform is heated to a temperature of about 600° C. for about one hour. Generally, at a temperature greater than 500° C., substantially all of the unreacted binder is vaporized from the green preform. The unreacted polyorganic acid, unreacted second organic compound (if any), and non-organic components of the reacted organic compounds are vaporized by heat-induced decomposition.

Prior to heating, the green preform is removed from the mold and heated to the first temperature in a separate conventional heating apparatus well known to those of ordinary skill in the art, such as an oven. The green preform is preferably heated in an inert or non-oxidizing atmosphere, such as argon gas. Generally, the green preform is heated at atmospheric pressure, although the green preform may be heated while being subjected to a pressure above or below atmospheric pressure, as would be understood by one of ordinary skill in the art.

The resulting preform is heated to a second temperature greater than the first temperature to sinter the metal particles. As used herein, the term "sintering" refers to the formation of a coherently bonded mass of metal powder by heating at a temperature below the melting point of the metal. That is, during sintering the metal to metal contacts form necks but the metal does not flow or propagate. It is believed that at least a portion of the carbon fiber chains remain covalently bonded to the metal surface after sintering.

The sintering is also carried out in an inert or non-oxidizing atmosphere such as argon gas. If oxygen is present in the atmosphere during heating to the first temperature or sintering, a portion of the carbon bonding the metal particles together may be released from the structure and join with the oxygen to form carbon monoxide or carbon dioxide. Therefore, the absence of oxygen is preferred.

The preferred sintering temperature for iron or iron-based alloys is approximately 1120° C. for a period of about one hour, although one of ordinary skill in the art would understand that the sintering temperature and time may vary for different metal particles.

The sintering yields a molded article having a porosity roughly equivalent to the original binder content. Even when the green preform has a porosity greater than 50% prior to heating, the application of heat in the steps of the present process vaporizes the non-organic components of the reacted polyorganic acid, the unreacted polyorganic acid, and sinters the metal particles causing only about a 2 to 3% density reduction.

The method may further comprise an additional step of heating the green preform to an intermediate temperature, such that at least a portion of the polyorganic acid and at least a portion of the organic compound chemically react. This additional heating step would precede the step of heating the green preform to the first temperature. By heating the green preform to an intermediate temperature, a reaction between the polyorganic acid and organic compound is facilitated which forms a stable three-dimensional crosslink network between the polyorganic acid and organic compound.

A preferred intermediate temperature is about 150° C. to about 250° C. applied over a period of about one hour, although one of ordinary skill in the art would understand that the intermediate temperature and time period may vary depending upon such factors as the polyorganic acid and/or organic compound used. Preferably, about 5 to about 30% of the polyorganic acid and organic compound are cross-linked, but this percentage may vary as desired.

The step of heating the molded article to the intermediate temperature (curing) may be carried out subsequently to the step of applying pressure to the flowable mixture or the two steps may be carried out simultaneously. Presently, it is preferred that the die compaction ("DC") and curing ("C") steps occur simultaneously ("DCC") rather than sequentially ("DC/C"). In the DC/C process, the molded article is removed from the pressurizing device prior to heating to the intermediate temperature.

Figure 2:
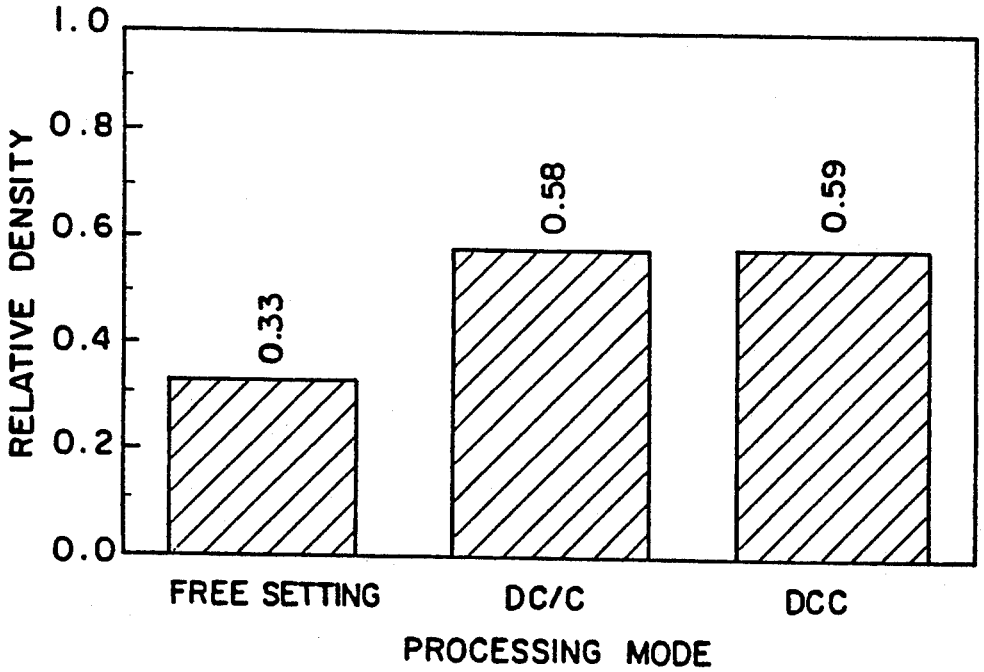
FIG. 2 is a graph of relative density as a function of the processing mode.

FIG. 2 shows that the DCC processing method yields a denser molded article than either the DC/C processing method or allowing the article to be molded without the application of pressure ("free setting"). In order to determine the effect of the processing method on the relative density of the molded article, slurries of 80 weight percent ANCORSTEEL 85HP TM (106–150 μm) powder and 20 weight percent carbonyl iron fine powder (5 μm) were evaluated using the free setting, DC/C and DCC processing methods. In the free setting method, the flowable slurry was not compacted but was cured at an intermediate temperature of about 180° C. for about 1 hour. In the DC/C method, 2.5 tons per square inch (tsi) of pressure was applied for about 1 hour, followed by curing at about 180° for about 1 hour. The application of pressure and the curing step (same conditions as DC/C) were carried out simultaneously in the DCC method. Each resulting preform was heated to about 600° C. for about 1 hour and sintered at about 1120° C. for an additional three hours. As best shown in FIG. 2, the DCC method yielded the highest relative density, namely 0.59 g/cm$^3$. In comparison, the DC/C method yielded a relative density of 0.58 g/cm$^3$ and the free setting method only 0.33 g/cm$^3$.

Figure 3:
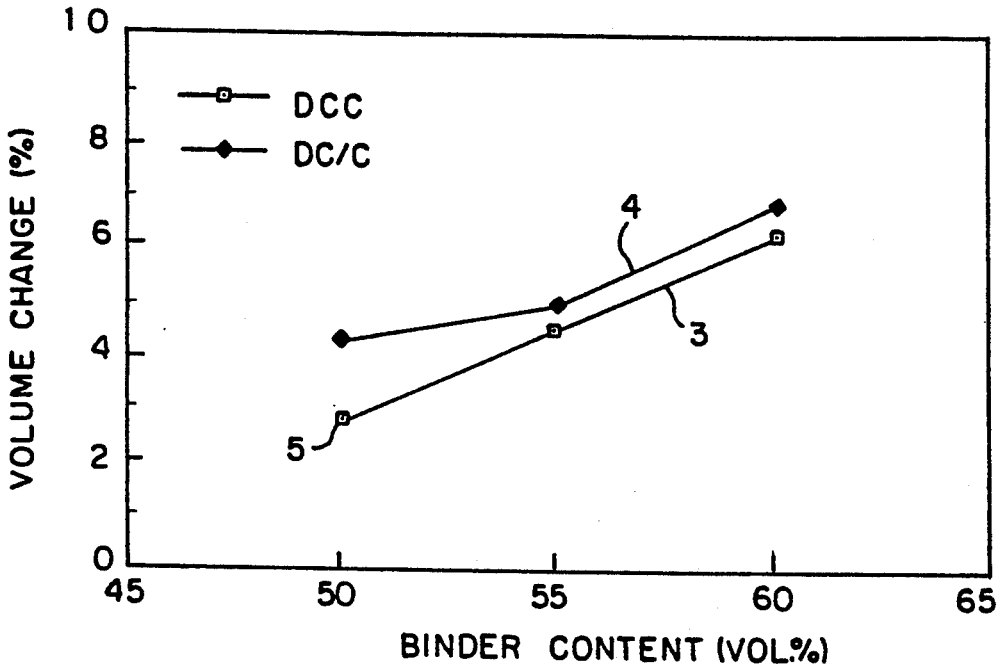
FIG. 3 is a graph of percentage of volume change as a function of binder content measured in volume percent.

Referring now to FIG. 3, the percent volume change was measured for molded articles formed from slurries of 80 weight percent ANCORSTEEL 85HP TM (106–150 μm) and 20 weight percent carbonyl iron fine powder (5 μm) combined with 50, 55, and 60 volume percent binder. The binder for each slurry was composed of 3 parts of the aqueous solution of polyacrylic acid to 1 part glycerin. The green preforms were processed by either the DC/C or DCC method; then the green volume of each preform was ascertained. The preforms were subsequently heated to about 600° C. for about 1 hour, and the volume of each preform was determined. After sintering at about 1120° C. for about 3 hours, the final volume of each article was determined. Less than a 2 to 3% volume change from the green preform to the sintered molded article for 50 volume percent binder, indicated at 5, was observed.

Articles processed using the preferred DCC method (indicated generally by line 3) consistently show a smaller volume change than articles processed by the DC/C method (indicated generally by line 4). FIG. 3 also shows that the preferred binder content is approximately 50% by volume, as indicated at 5. At 50% binder content, the volume change is about 2–3%. As the binder content increases, the volume change also increases. One of ordinary skill in the art, however, would understand that the preferred binder content may vary based upon such factors as the processing parameters and materials used.

Figure 4:
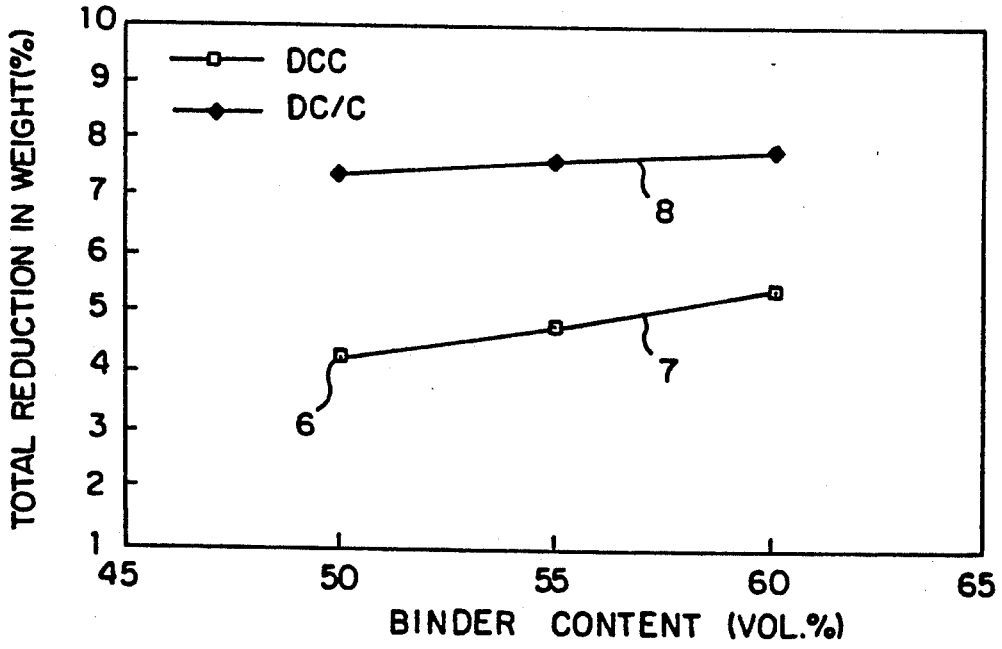
FIG. 4 is a graph of the percent total reduction in weight as a function of binder content measured in volume percent.

FIG. 4 shows that an article fabricated using the preferred 50% binder content and the DCC method (indicated by 6) loses only about 4% of its weight from the green preform to the sintered article. FIG. 4 also shows that articles processed by the DCC method (indicated generally by 7) average about 2–3% less reduction in weight than articles processed by the DC/C method (indicated generally at 8).

Figure 5:
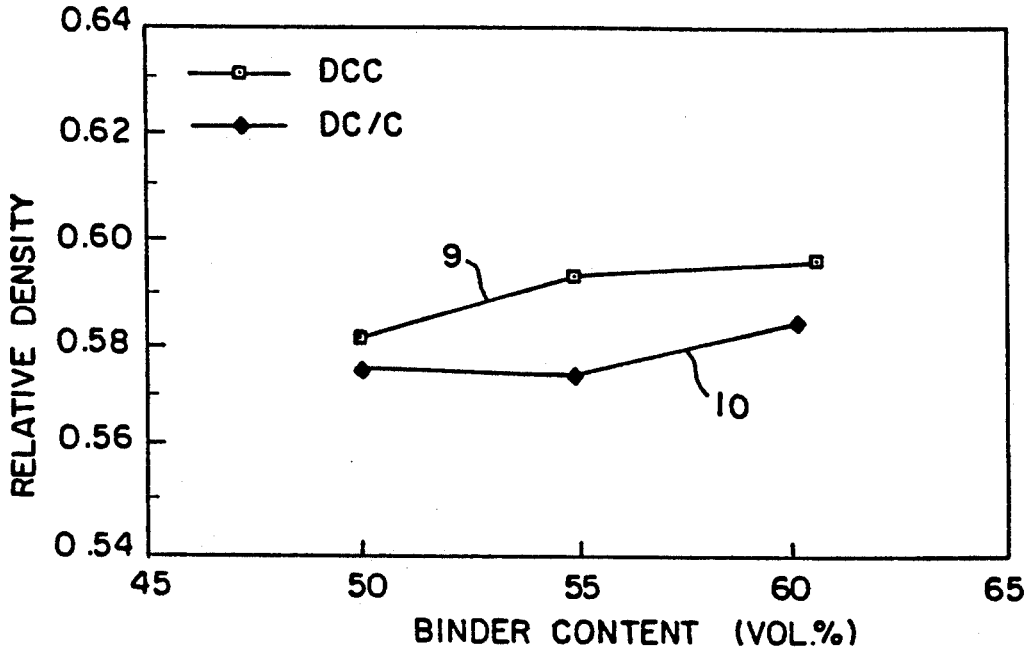
FIG. 5 is a graph of relative density as a function of binder content measured in volume percent.

FIG. 5 shows that articles processed by the preferred DCC method (indicated generally by 9) have a higher relative density than articles processed by the DC/C method (indicated generally by 10). While articles having original binder contents of 55 and 60 volume percent are slightly denser than an article prepared using the preferred 50 volume percent binder, the considerations of low volume change and low weight loss offset the advantage of a minor gain in density. The methods of preparing the examples shown in FIGS. 4 and 5 are the same as those used for preparing the examples in FIG. 3.

Figure 6:
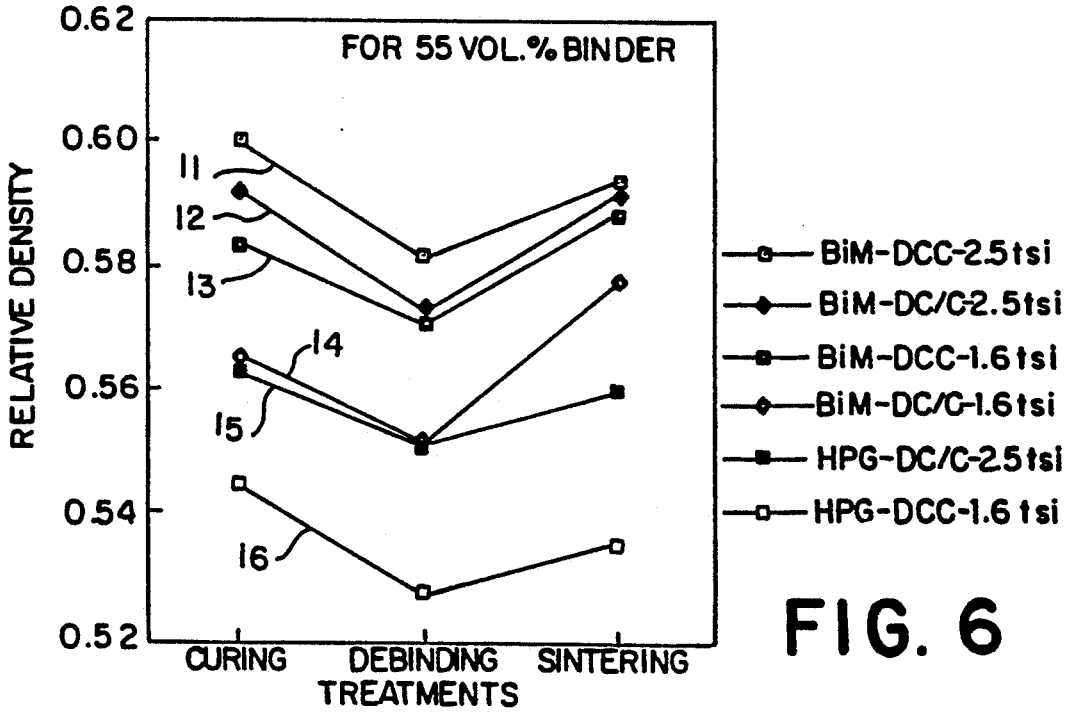
FIG. 6 is a graph of the relative density of a mixture having 55% by volume binder as a function of the curing, debinding, and sintering treatments.

As best shown in FIG. 6, the relative density of the preforms decreases when the preforms are subjected to the first temperature. However, during the sintering step the relative density consistently increases, almost to the pre-debinding levels due to diffusion of the metal particles during the sintering process. FIG. 6 also shows that articles formed from a bi-modal metal particle group, indicated generally by 11, 12, 13 and 14, have a consistently higher density than articles formed from a monomodal metal particle group, indicated generally at 15 and 16. Furthermore, FIG. 6 clearly shows that an article having a bimodal metal particle group prepared by the DCC method at an elevated pressure of 2.5 tsi, indicated generally at 11, has a higher relative density than articles processed at a lower pressure, by use of the DC/C process, or using a monomodal metal particle group.

The method may further comprise an additional step of infiltrating a second metal into the interstices within the molded article for increasing the strength of the molded article after the preform is sintered. This additional step may be necessary if higher strength and thermal conductivity are needed in the final product, or if it is desired to eliminate any porosity. Preferably, the second metal has a lower melting point than the first metal. It is preferred that the second metal be copper, although one of ordinary skill in the art would understand that the second metal may be any metal having a lower melting point than the first metal, such as tin.

Methods for infiltrating a molded article with a metal are well known to those of ordinary skill in the art. A presently preferred copper infiltration method involves placing a slug of the second metal atop the molded article. Sufficient heat is applied to the second metal and molded article by conventional means so as to melt the second metal without melting or deforming the molded article. The second metal generally infiltrates the interstices in the molded article by capillary effect. However, pressure may be applied to increase the rate and completeness of infiltration.

The present invention surpasses prior art molding methods by permitting the formation of intricate or irregularly shaped parts from powder compositions having inadequate flow properties. Shrinkage, distortion, and density variations typically produced upon heating of the parts is also minimized. The molding method of the present invention may be used to form virtually any metal article, final parts or molds for making other parts. For example, the method has been found to be particularly advantageous for making prototype parts (positives).

It will be appreciated by those skilled in the art that changes could be made to the embodiments described above without departing from the broad inventive concept thereof. It is understood, therefore, that this invention is not limited to the particular embodiments disclosed, but is intended to cover modifications which are within the spirit and scope of the invention as defined by the appended claims.

What is claimed is:

1. A method for molding metal particles, comprising the steps of:

a. mixing metal particles with a polyorganic acid to form a generally flowable mixture, said polyorganic acid having the general formula:

$$R-\overset{\overset{\displaystyle O}{\|}}{C}-OH,$$

wherein R is a long chain polymer having organic groups selected from aliphatic and aromatic, and said polyorganic acid being one which will chemically react with said metal particles;

b. transferring said flowable mixture to a mold before the chemical reaction between said metal particles and said polyorganic acid proceeds so far as to substantially increase the viscosity of said flowable mixture;

c. applying pressure to said flowable mixture in said mold to form a preform;

d. heating said preform to a first temperature to vaporize substantially all of the non-organic components of the reacted polyorganic acid from said preform; and e. heating said preform to a second temperature greater than said first temperature to sinter said metal particles.

2. A method according to claim 1, wherein said metal particles comprise first and second groups of particles, said first group having an average particle size greater than the average particle size of said second group.

3. A method according to claim 2, wherein said first group of particles comprises about 70 to about 90 weight percent of said metal particles and said second group of particles comprises about 10 to about 30 percent of said metal particles.

4. A method according to claim 1, wherein said metal particles are selected from the group consisting of transition metals and alloys thereof.

5. A method according to claim 3, wherein said metal particles are carbon steel.

6. A method according to claim 1, wherein said polyorganic acid is polyacrylic acid.

7. A method according to claim 1, wherein said polyorganic acid is in the form of an aqueous solution.

8. A method according to claim 7, wherein said aqueous solution comprises about 25 percent by volume polyacrylic acid.

9. A method according to claim 7, wherein said mixture contains about 40 to about 60 volume percent of said aqueous solution of said polyorganic acid and the remainder is said metal particles.

10. A method according to claim 1, wherein the step of mixing said metal particles with said polyorganic acid further comprises mixing said metal particles with a second organic compound.

11. A method according to claim 10, wherein said second organic compound is a polyol.

12. A method according to claim 10, wherein the ratio of said aqueous solution of said polyorganic acid to said second organic compound is about 3 to 1.

13. A method according to claim 1, wherein the step of mixing said metal particles with said polyorganic acid further comprises mixing said metal particles with graphite.

14. A method according to claim 1, wherein the pressure applied to said flowable mixture is about 1.6 to about 2.5 tons per square inch.

15. A method according to claim 1, wherein the step of applying pressure to said flowable mixture comprises applying hydrostatic pressure to said flowable mixture.

16. A method according to claim 1, wherein the step of heating said preform to said first temperature further comprises vaporizing substantially all of the unreacted polyorganic acid from said green preform.

17. A method according to claim 1, wherein the first temperature is between about 400° C. and 600° C.

18. A method according to claim 1, wherein said second temperature is about 1120° C.

19. A method according to claim 7, further comprising an additional step of heating said preform to an intermediate temperature, such that at least a portion of said polyorganic acid and at least a portion of said second organic compound chemically react, prior to the step of heating said preform to said first temperature.

20. A method according to claim 19, wherein said intermediate temperature is between about 150° C. and about 250° C.

21. A method according to claim 1, further comprising an additional step of infiltrating a second metal into the interstices within said molded article for increasing the strength of said molded article after the step of heating said preform to said second temperature.

22. A method according to claim 11, wherein said second metal is copper.

* * * * *